US005214997A

United States Patent [19]

Lebret

[11] Patent Number: 5,214,997

[45] Date of Patent: Jun. 1, 1993

[54] CONTROL CIRCUIT FOR A DOUBLE-ACTING HYDRAULIC JACK AND SLIDE DISTRIBUTOR FOR SUCH A CIRCUIT

[75] Inventor: Pierre Lebret, Le Chesnay, France

[73] Assignee: Bendix Europe Services Techniques, Drancy, France

[21] Appl. No.: 679,473

[22] Filed: Apr. 2, 1991

[30] Foreign Application Priority Data

Apr. 27, 1990 [FR] France ..... 90 05362

[51] Int. Cl.[5] ..... F15B 11/08; F15B 13/04

[52] U.S. Cl. ..... 91/420; 91/421; 91/440

[58] Field of Search ..... 91/420, 440, 436, 433, 91/462, 468, 421; 60/468

[56] References Cited

U.S. PATENT DOCUMENTS

| | | | |
|---|---|---|---|
| 1,964,196 | 6/1934 | Cuttat | 91/421 |
| 3,576,192 | 4/1971 | Wood et al. | 91/420 X |
| 3,974,742 | 8/1976 | Johnson | 91/420 |
| 4,006,663 | 2/1977 | Baatrup et al. | 91/420 X |
| 4,012,031 | 3/1977 | Mitchell et al. | 91/420 X |
| 4,266,464 | 5/1981 | Baatrup et al. | 91/420 X |
| 4,840,111 | 6/1989 | Garnjost | 91/436 |

FOREIGN PATENT DOCUMENTS

| | | | |
|---|---|---|---|
| 2008092 | 4/1980 | Fed. Rep. of Germany | 91/420 |
| 45-30726 | 5/1970 | Japan | 91/420 |

*Primary Examiner*—Edward K. Look
*Assistant Examiner*—John Ryznic
*Attorney, Agent, or Firm*—Larry J. Palguta; Ken C. Decker

[57] ABSTRACT

The control circuit of a double-acting hydraulic jack (10), consisting of a piston (12) connected to an output rod (18) and separating a cylinder into two chambers (14, 16), comprises a source of fluid under pressure (20, 26), a distribution system (28, 28', 52, 52') alternately putting one of the chambers, or control chamber, in communication with the source of fluid under pressure (20, 26) and the other chamber, or controlled chamber, in communication with a reservoir of fluid under low pressure (25), in order to control the movement of the piston (12) of the jack (10). The jack comprises an auxiliary circuit (50, 120, 122) for preventing communication between the controlled chamber and the reservoir (25), interrupting communication between the control chamber and the source of fluid under pressure (20, 26) and allowing communication between the controlled and control chambers when the pressure of the fluid in the controlled chamber exceeds a predetermined value.

5 Claims, 3 Drawing Sheets

CONTROL CIRCUIT FOR A DOUBLE-ACTING HYDRAULIC JACK AND SLIDE DISTRIBUTOR FOR SUCH A CIRCUIT

BACKGROUND OF THE INVENTION

The present invention belongs to the sector of the control of hydraulic jacks.

Hydraulic jacks are well-known components which convert the hydraulic energy which they receive into mechanical energy which can be considerable. Double-acting jacks consist of a cylinder in which slides a piston dividing the cylinder into two chambers, the piston being connected to an output rod.

When it is intended that the jack should work in one direction in the conventional way, a distribution system is controlled so as to admit fluid under pressure into one of the chambers, while the fluid contained in the other chamber is discharged into a low-pressure reservoir, from which a high-pressure pump draws, to allow the piston to move in the cylinder.

There can be circumstances in which the jack is already subjected to an external force tending to cause the piston to move in one direction and where it is also desirable that the jack should indeed move in this same direction. This occurs, for example, when, after the jack has been actuated, it is desired that it should resume its rest position, corresponding, for example, to the mid-position of the piston in the cylinder, and when the external force to which the jack is subjected is provided by systems for recentering the piston. In general the movement of the piston is obtained once again in the conventional way by the admission of fluid under pressure into one of the chambers and the discharge of the fluid from the other chamber towards the reservoir.

When the external forces are resistant, it will easily be appreciated that the purpose of connecting one of the chambers to the reservoir is to avoid impeding the functioning of the jack. However, in the above-mentioned instances where the jack is already stressed in the direction in which the movement of the piston is to take place, that is to say when the external forces are driving forces, the chamber which is conventionally connected to the reservoir is under pressure precisely as a result of the external stress. Discharging the fluid under pressure to the reservoir therefore obviously constitutes a loss of energy which can be considerable, depending on the particular installation controlled by the jack.

SUMMARY OF THE INVENTION

An object of the invention is, therefore, to provide, in the control circuit, an auxiliary circuit which recovers the outlet fluid of the jack when its pressure exceeds a predetermined value, this auxiliary circuit being of simple and reliable design and not prompting an appreciable increase in the cost of the control circuit of the jack.

According to the present invention, there is provided a control circuit of a double-acting hydraulic jack, consisting of a piston connected to an output rod and separating a cylinder into two chambers, the circuit comprising a source of fluid under pressure, a distribution system alternately putting one of the chambers, or control chamber, in communication with the source of fluid under pressure and the other chamber, or controlled chamber, in communication with a reservoir of fluid under low pressure, in order to control the movement of the piston of the jack.

According to the invention, the control circuit comprises an auxiliary circuit for preventing communication between the controlled chamber and the reservoir and for interrupting communication between the control chamber and the source of fluid under pressure when the pressure of the fluid in the controlled chamber reaches a predetermined value.

According to an advantageous characteristic of the invention, the auxiliary circuit makes it possible to establish communication between the controlled chamber and the control chamber when the pressure of the fluid in the controlled chamber exceeds the predetermined value.

BRIEF DESCRIPTION OF THE DRAWINGS

The invention will now be described by way of example with reference to the accompanying drawings in which.

DETAILED DESCRIPTION OF THE INVENTION

Figure 1:
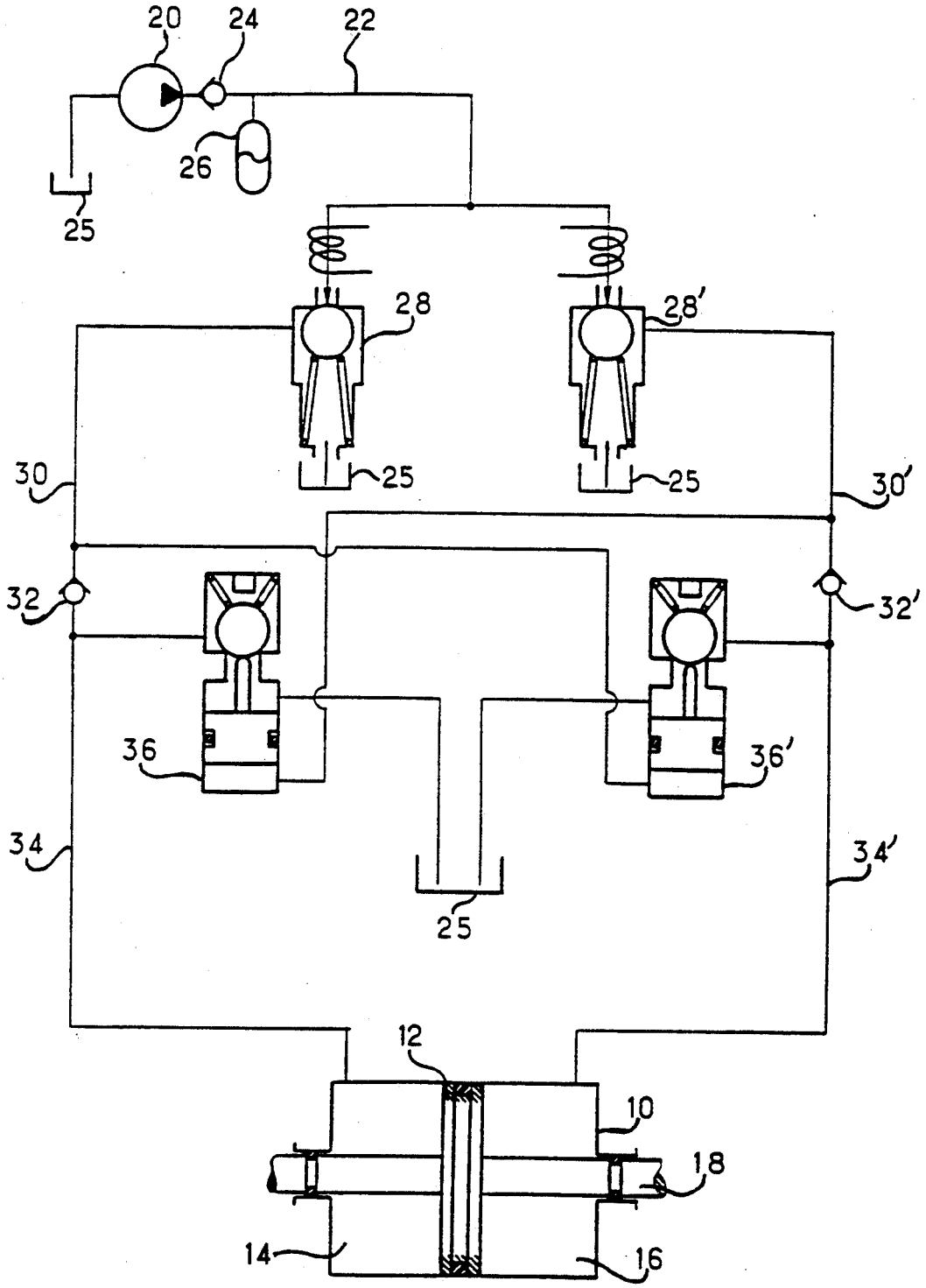
Fig: 1 PRIOR ART
FIG. 1 shows a theoretical diagram of a control circuit of a double-acting hydraulic jack of the prior art.

FIG. 1 illustrates a known control circuit for a double-acting jack 10 divided by a piston 12 into two chambers 14 and 16 of variable volume. The piston is mounted on a rod 18. The hydraulic feed is ensured by a pump 20 connected to a feed pipe 22 via a non-return valve 24. The feed pipe 22 is also connected to a pressure accumulator 26.

The control circuit comprises, as regards the chamber 14, a three-way solenoid valve 28 which puts a pipe 30 in communication either with the high-pressure pipe 22 or with a reservoir 25. When the solenoid valve 28 is not energized, it puts the pipe 30 in communication with the reservoir 25. The control circuit likewise comprises, as regards the chamber 16, a three-way solenoid valve 28' which puts a pipe 30' in communication either with high-pressure pipe 22 or with the reservoir 25. When the solenoid valve 28' is not energized, it puts the pipe 30' in communication with the reservoir 25.

The control circuit can be controlled by a computer or a microprocessor (not shown) which controls each of the solenoid valves 28, 28' and the pump 20, for example with a position interlock of the jack.

The pipe 30 is connected to the feed pipe 34 of the chamber 14 via a non-return valve 32. The pipe 34 is likewise connected to the reservoir by means of a controlled valve 36. This valve is controlled by the pressure present in the pipe 30' symmetrical with the pipe 30, in the circuit corresponding to the second chamber 16 of the jack. If the solenoid valve 28' symmetrical with the solenoid valve 28 and controlling the pressure in the second chamber 16 is controlled, the pressure in the pipe 30' causes the valve 36 to open and the chamber 14 to be connected to the reservoir. Conversely, if the solenoid valve 28 is energized, the pressure in the pipe 30 controls the opening of a valve 36' which connects the chamber 16 to the reservoir. Thus, the chambers 14 and 16 are alternately one under pressure and the other connected to the reservoir. However, if the two solenoid valves 28, 28' are at rest, the two chambers 14 and 16 are kept isolated as a result of the closing of the valves 36, 36' and non-return valves 32, 32'. If, for example, during an operation the pressure were to fall in the high-pressure pipe 22, this would cause the closing of the valve 36 or 36' which was open and consequently the automatic isolation of the chambers 14 and 16 and the immobilization of the piston 12 in the position which it occupied at the moment when the hydraulic failure occurred.

During normal functioning, for example after an operation which has brought the piston 12 to the left in FIG. 1, if the piston 12 is to be returned to the right it was seen above that it is sufficient to energize the solenoid valve 28 in order to admit fluid under pressure into the chamber 14, which will be called the control chamber, and in order to connect the chamber 16, which will be called the controlled chamber, to the reservoir, this indeed bringing about the desired movement of the piston 12 to the right. However, the rod 18 can itself also be subjected to external stresses tending also to cause it to move to the right. These stresses can come, for example, from steering return systems, if the jack 10 is included a hydraulic steering control system of a vehicle with power-assisted steering, from suspension bounces, if the jack 10 is included in a hydraulic vehicle suspension system, or in general terms from the action of the external environment on the jack. In these cases, before the control, the pressure of the fluid in the controlled chamber 16 is not that of the low-pressure reservoir 25, but rises to much higher values, especially higher than that of the fluid in the control chamber 14. Discharging the fluid under pressure to the reservoir entails a needless consumption of hydraulic fluid and obviously a loss of energy.

To rectify this situation, according to the invention, there is arranged in the control circuit an auxiliary circuit which is activated as soon as the pressure in the controlled chamber exceeds that of the control chamber by a particular amount.

Figure 2:
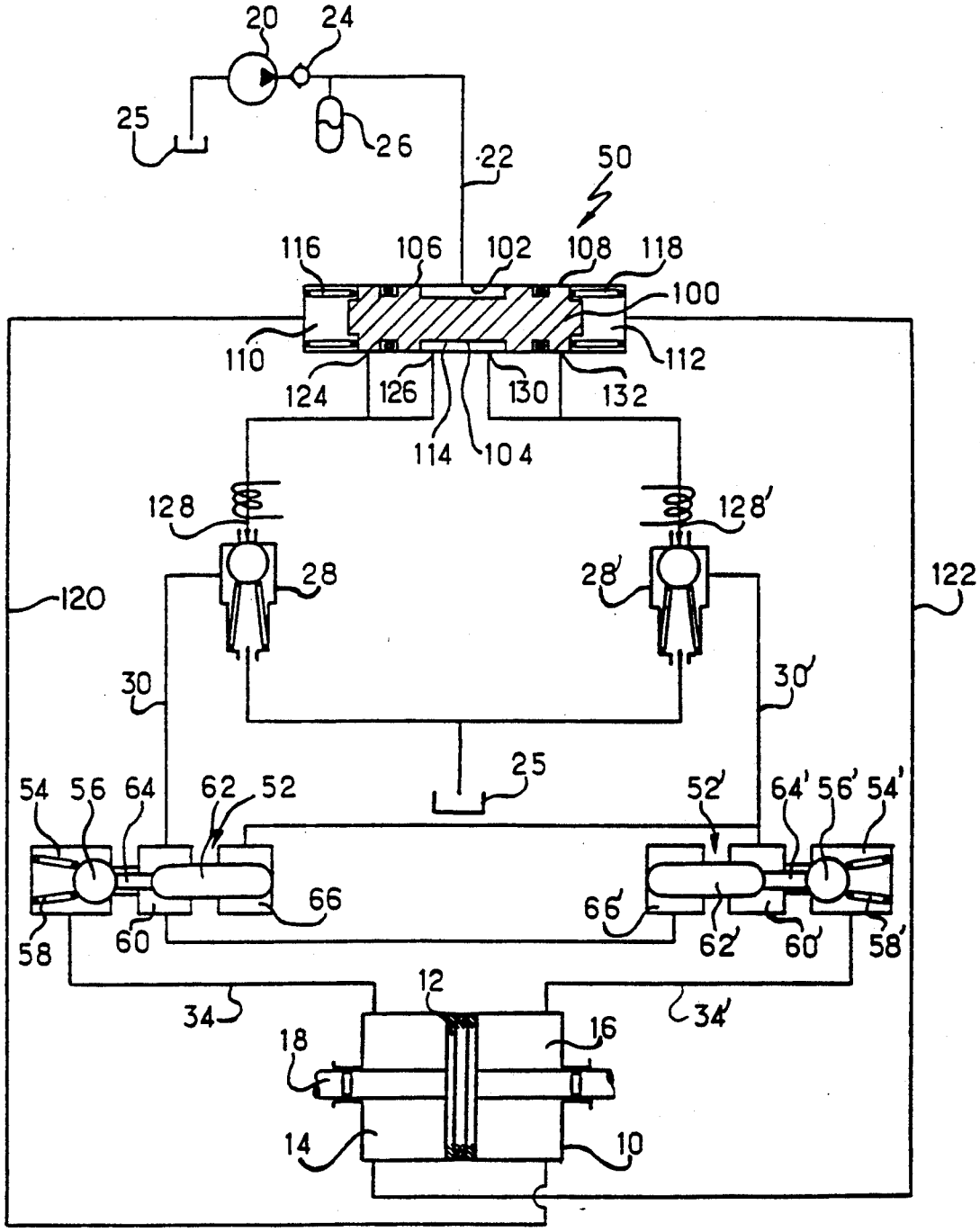
FIG. 2 shows a theoretical diagram of a control circuit of a double-acting hydraulic jack according to one embodiment of the invention.

FIG. 2 illustrates a control circuit according to the invention, in which the elements identical to those of FIG. 1 bear the same reference numerals.

The control circuit is fed, as before, by the pump 20 connected to the feed pipe 22 via a non-return valve 24, the pipe 22 being connected to a pressure accumulator 26 and feeding the solenoid valves 28 and 28' via a distributor 50 which will be described later.

The pipe 30 at the outlet of the solenoid valve 28 is connected to the feed pipe 34 of the chamber 14 by means of a controlled valve 52. This valve 52 comprises a first chamber 54, into which opens the pipe 34 and which contains a ball 56 loaded by a spring 58 towards a rest position in which it prevents communication with a second chamber 60 into which the pipe 30 opens. The second chamber 60 is delimited by a piston 62 carrying, on one side, a pin 64 capable of lifting the ball 56 from its seat when the pressure in a third chamber 66 on the other side of the piston 62 causes the latter to move counter to the return spring 58 and to the pressure prevailing in the chamber 54. The cross-section of the piston 62 is identical to that of the seat of the ball 56. The third chamber 66 is in communication with the pipe 30' symmetrical with the pipe 30 in the feed circuit of the chamber 16. It can thus be seen that the valve 52 is controlled by the pressure present in the circuit 30' corresponding to the second chamber 16 of the jack. The latter circuit comprises a valve 52' identical to the valve 52, and its elements bearing the same reference numerals given a "prime" mark therefore need no detailed description.

If it is desired, for example, that the piston of the jack should move to the left, when looking at FIG. 2, the pump 20 is put into operation, the solenoid valve 28' is energized and the solenoid valve 28 is left at rest. The pressure in the pipe 22 is therefore transmitted via the distributor 50 and the solenoid valve 28' into the pipe 30' and into the second chamber 60'. The ball 56' lifts under the action of this pressure which is then transmitted by the pipe 34' to the chamber 16 of the jack. Simultaneously, the pressure in the pipe 30' is transmitted to the third chamber 66 of the valve 52, the effect of this being to cause the piston 62 to move to the left, when looking at FIG. 2, and consequently lift the ball 56 from its seat, thereby establishing communication between the first and second chambers 54 and 60 and therefore between the pipes 30 and 34. Since the solenoid valve 28 is not energized, the pipe 30 communicates with the reservoir 25, and consequently the chamber 14 of the jack is therefore connected to the reservoir. The piston 12 can thus move to the left.

The chambers 14 and 16 are thereby alternately one under pressure and the other connected to the reservoir. However, if the two solenoid valves 28, 28' are at rest, the two chambers 14 and 16 are kept isolated as a result of the closing of the valves 52 and 52'.

It will be noted, in passing, that this advantageous arrangement of the controlled valves 52 and 52' makes it possible to avoid arranging the non-return valves 32 and 32' of FIG. 1 in the pipes 30 and 30'. For example, if the pressure in the high-pressure pipe 22 were to fall during an operation of the jack, this would cause the closing of the valve 52 or 52' which was open and consequently the automatic isolation of the chambers 14 and 16 and therefore the immobilization of the piston 12 in the position which it occupied at the moment when the fault in the hydraulic circuit occurred.

After the above-described operation to move the piston to the left, the return of the piston to the right will be brought about symmetrically by energizing the solenoid valve 28 and requires no detailed description.

During this operation to the right, the pressure in the chamber 16 can be made to rise for the reasons mentioned above. In this case, the external force is a driving force. The auxiliary circuit according to the invention then comes into play.

The auxiliary circuit mainly comprises the distributor 50 arranged between the high-pressure pipe 22 and the solenoid valves 28 and 28'. The distributor 50 consists of a slide 100 sliding in a bore 102. This slide has a central groove 104 between two bearing surfaces 106 and 108 interacting sealingly with the bore 102 in order to divide it into three chambers: an end chamber 110, 112 on each side of the slide and an annular central chamber 114 defined by the central groove 104. The slide 100 is symmetrical and is maintained in the rest position in the middle of the bore 102 by springs 116 and 118 of the same rigidity on each side of the slide.

The auxiliary circuit also possesses a pipe 120 putting the chamber 110 in communication with the pipe 34', and a pipe 122 connecting the chamber 112 to the pipe 34. The high-pressure pipe 22 opens into the central chamber 114 via a port which is never covered by the bearing surfaces 106 and 108.

The bearing surface 106 interacts with two ports 124 and 126, in such a way that the port 126 is exposed and opens into the central chamber 114 when the slide is in its central rest position or has moved to the left, and is covered when the slide 100 moves to the right (in FIG. 2), while the port 124 is covered by the slide in its central rest position or moved to the left and is exposed and opens into the chamber 110 when the slide is moved to the right (in FIG. 2). The two ports 124 and 126 both communicate with a pipe 128 connected to the solenoid valve 28.

Likewise, the bearing surface 108 interacts with two ports 130 and 132, in such a Way that the port 130 is exposed and opens into the central chamber 114 when the slide is in its central rest position or has moved to the right, and is covered when the slide 100 moves to the left (in FIG. 2), while the port 132 is covered by the slide in its central rest position or moved to the right and is exposed and opens into the chamber 112 when the slide is moved to the left (in FIG. 2). The two ports 130 and 132 both communicate with the pipe 128' connected to the solenoid valve 28'.

During normal functioning, if it is desired, for example, that the piston 12 of the jack should move to the right (in FIG. 2), the pump 20 is put into operation and the pressure in the pipe 22 is transmitted to the central chamber 114 of the distributor 50. If, for example, the latter is at rest at this moment, the ports 126 and 130 are exposed and the fluid under pressure therefore arrives at the solenoid valves 28 and 28'. If the solenoid valve 28 alone is energized, the pressure is transmitted by the pipe 30 into the second chamber 60 of the controlled valve 52. The ball 56 lifts under the action of this pressure which is then transmitted by the pipe 34 to the chamber 14 of the jack. Simultaneously, the pressure in the pipe 30 is transmitted to the third chamber 66' of the valve 52', the effect of this being to cause the piston 62' to move to the right, when looking at FIG. 2, and therefore lift the ball 56' from its seat, thereby establishing communication between the first and second chambers 54' and 60' and therefore between the pipes 30' and 34'. Since the solenoid valve 28' is not energized, the pipe 30' communicates with the reservoir 25, and consequently the chamber 16 of the jack is therefore connected to the reservoir. The piston 12 can thus move to the right. Since the chamber 16 is connected to the reservoir, the chamber 110 of the distributor 50 experiences the same situation by means of the pipe 120. In contrast, the pressure prevailing in the chamber 14 is transmitted by the pipe 122 to the chamber 112 of the distributor 50.

The unbalance of the pressures on the two sides of the slide 100 causes the latter to move to the left. The bearing surface 106 thereby continues to cover the port 124 and expose the port 126. The solenoid valve 28 therefore continues to be fed and the feed circuit of the chamber 14 is unchanged. The bearing surface 108 will itself cover the port 130 and expose the port 132. The pressure in the chamber 14 is therefore transmitted by the pipe 122 and the chamber 112 to the solenoid valve 28' which is closed. It will be seen that there is no change in the return circuit of the chamber 16.

In contrast, if pressure in the chamber 16 is high, for example because the rod 18 is pushed to the right by means of an external force and becomes higher than the pressure in the chamber 14, the unbalance of the pressures in the chambers 14 and 16 is transmitted to the chambers 110 and 112 on each side of the slide 100 and, since the pressure in the chamber 110 is higher than that prevailing in the chamber 112, causes the slide 100 to move to the right in FIG. 2. If the pressure difference is sufficient to compress the spring 118, the slide thereby covers the port 126, thus preventing the possibility of supplying fluid under pressure to the solenoid valve 28 via the pipe 22 by means of the source of fluid under pressure, and exposes the port 124 and consequently allows the fluid in the controlled chamber 16, under a pressure higher than that of the fluid in the control chamber 14, to be reinjected towards the solenoid valve 28 and then towards the chamber 14 if the solenoid valve is energized. The pressure in the chamber 16 is transmitted to the chamber 54' of the valve 52', and the left face of the piston 62' is subjected, in the chamber 66', to the pressure of the chamber 14 by way of the pipe 30 and the chamber 60 of the valve 52, still subjected to the pressure of the chamber 14 of the jack. Since the cross-section of the piston 62' is equal to the cross-section of the seat of the ball and the pressure in the chamber 54' is equal to that of the chamber 16 and slightly higher than or equal to the pressure in the chamber 66' which is equal to that of the chamber 14, the ball 56' does not lift and prevents communication between the chamber 16 and the reservoir 25.

It will therefore be seen that, by means of the auxiliary circuit of the invention, when the pressure in the controlled chamber 16 becomes higher than that of the control chamber 14 with a sufficient difference, not only is communication between the controlled chamber 16 and the reservoir 25 interrupted, but also the feed of fluid to the chamber 14 by the source of fluid under high pressure is interrupted, being replaced by the feed to this chamber of the fluid of the chamber 16 under a pressure higher than that of the chamber 14.

This affords a considerable energy saving, since the energy of the fluid of the chamber 16 which would otherwise be lost in the reservoir 25 is recovered, thereby ensuring a reduction in the consumption of hydraulic fluid in the control circuit of the jack.

Figure 3:
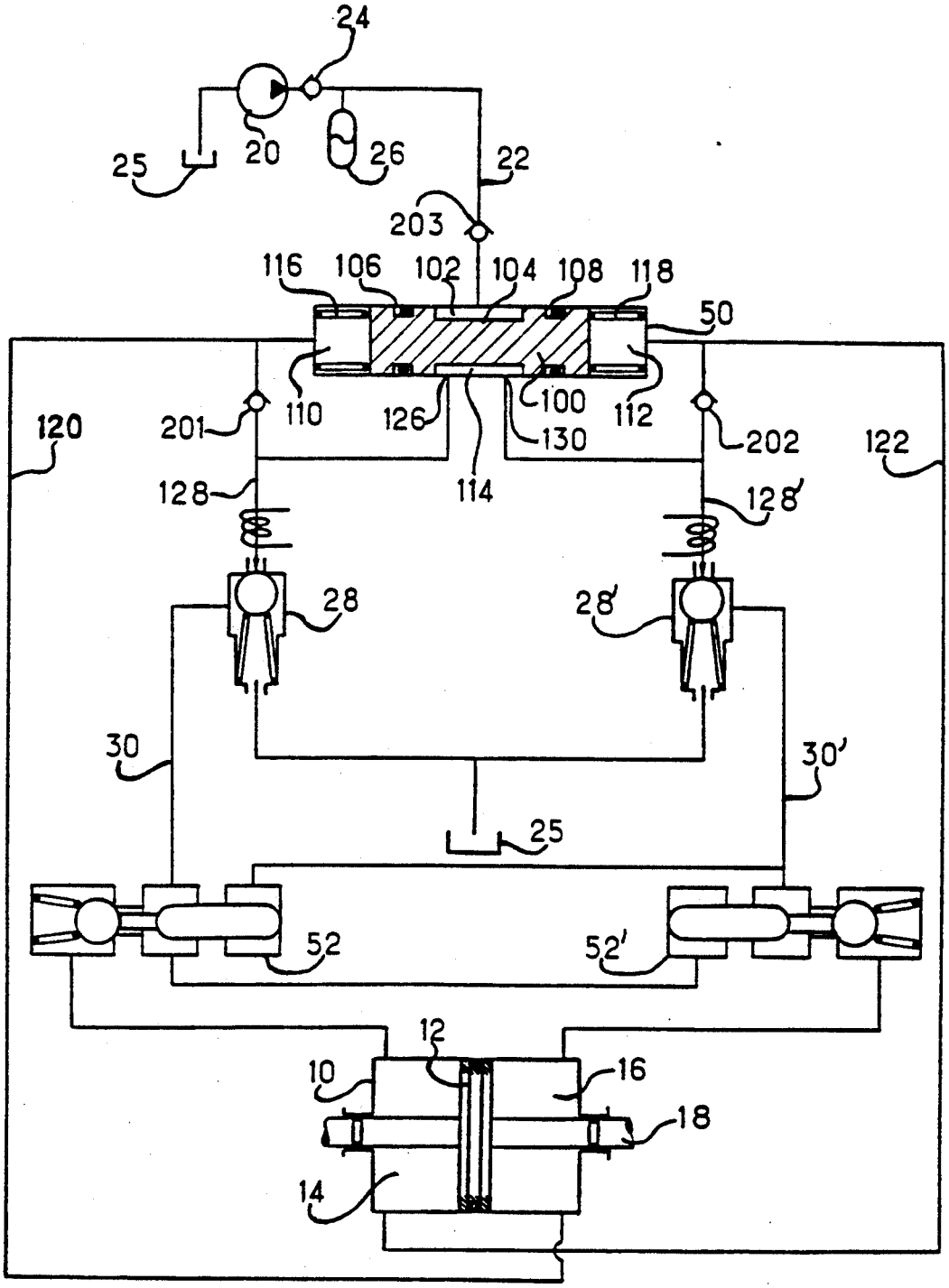
FIG. 3 shows a theoretical diagram of a control circuit of a double-acting hydraulic jack according to a second embodiment of the invention.

FIGS. 3 illustrates a second embodiment of the auxiliary circuit according to the invention. The distributor 50 is identical to that of FIG. 2, with the exception that the bearing surfaces 106 and 108 of the slide 100 each interact with a single port 126 and 130 respectively. The bearing surface 106 interacts with the port 126, in such a way that the port 126 is exposed and opens into the chamber 114 when the slide is in its rest position or has moved to the left (FIG. 3), and is covered when the slide 100 is moved to the right. Likewise, the bearing surface 108 interacts with the port 130, in such a way that it is exposed and opens into the cavity 114 when the slide is in the central position or moved to the right in FIG. 3, and is covered when the slide is moved to the left. The pipe 120 is connected to the pipe 128 by means of a non-return valve 201, and likewise the pipe 122 is connected to the pipe 128' by means of a non-return valve 202.

During normal functioning, if the difference between the pressures in the chambers 14 and 16 of the jack and therefore in the chambers 112 and 110 respectively is only slight, the slide 100 remains in a central position and the solenoid valves 28 and 28' can be fed by the high-pressure pipe 22 via the chamber 114. If, for example, the solenoid valve 28' is energized and the external force is resistant, the piston 12 of the jack moves to the left under the effect of the increase of pressure in the chamber 16, as described above, this pressure increase likewise being transmitted to the chamber 110 of the distributor 50. The slide 100 consequently moves to the right, the bearing surface 106 then covering the port 126, while the port 130 remains exposed and allows the solenoid valve 28' to be fed. The non-return valve 202 prevents the communication of fluid under pressure to the chamber 112 of the distributor and to the chamber 14 of the jack.

When the solenoid valve 28 is energized in order to move the piston of the jack to the right while an external driving force is being exerted on the piston rod, it has been seen that the pressure in the chamber 16 is then higher than the pressure in the chamber 14. The pressure in the chamber 110 is thus higher than the pressure in the chamber 112. The slide 100 moves to the right and the bearing surface 106 covers the port 126, thus interrupting the feed to the solenoid valve 28 of fluid under pressure coming from the pipe 22. In contrast, the solenoid valve 28 and therefore the chamber 14 can be fed by the pipe 120 and the non-return valve 201. Thus, as long as the pressure in the chamber 16 of the jack is higher than the pressure in the chamber 14, the latter can be fed with fluid under pressure coming from the chamber 16 and no longer from the high-pressure pipe 22, the valve 52' remaining closed, as described above.

A non-return valve 203 can be provided on the high-pressure pipe 22, to prevent a sudden rise of pressure in the chamber 16 from being transmitted, via the pipes 120 and 128, the port 126 and the chamber 114, to the hydraulic feed device 20, 26, before the slide 100 has moved. A hydraulic blocking of the jack is thus ensured. Likewise, the non-return valve 203 ensures the hydraulic blocking of the jack when the high-pressure feed system 20–26 is at rest or has failed.

A control circuit of simple and reliable design, without appreciable extra cost, for a double-acting jack has thus indeed been provided according to the invention. In fact, in all cases, the movement of the piston of the jack is controlled as a result of the energization of a single solenoid valve 28 or 28'. The distributor 50 is sensitive to the pressure difference in the chambers 14 and 16 of the jack, that is to say it detects the direction of the external forces to which the jack rod is subjected. According to the particular direction detected, it will make it possible either to feed fluid under pressure to the control chamber by means of the hydraulic high-pressure feed device 20, 26, if external forces are resistant or low, or to recover the fluid under pressure from the controlled chamber in order to supply it to the control chamber, if the external forces are driving forces. This therefore ensures a recovery of energy which would otherwise be lost in the low-pressure reservoir 25 and a reduction in the consumption of hydraulic fluid of the control circuit.

Such a device will be used in all active hydraulic systems, that is to say, irreversible systems using their own energy source, in order to convert them into systems reactive according to the external conditions to which they are subjected.

What we claim is:

1. A controllable double-acting hydraulic jack circuit, comprising a source of fluid under relatively high pressure, a reservoir of fluid under relatively low pressure, a piston connected to an output rod and separating a cylinder into first and second chambers, a fluid distribution network comprising controllable fluid connections establishing selectively a first communication of fluid between the source and one of said chambers, a control chamber, and a second communication of fluid between the other chamber, a controlled chamber, and the reservoir, and auxiliary connection means including first pressure sensitive means responsive to a fluid pressure in the controlled chamber for preventing the second communication between the controlled chamber and the reservoir and for interrupting the first communication between the control chamber and source of fluid under pressure when the pressure of the fluid in the controlled chamber reaches a predetermined value, said auxiliary connection means including second pressure sensitive means for establishing selectively a third communication of fluid between the controlled chamber and the control chamber when the fluid pressure in said controlled chamber exceeds said predetermined value, wherein the second pressure sensitive means comprises a distributor having a slide, said slide defining within the distributor only three chambers consisting of a single central chamber and two end chambers, and said two end chambers being connected respectively and directly by means of pipes with the first and second chambers of the jack.

2. The controllable double-acting hydraulic jack circuit according to claim 1, wherein said predetermined value of fluid pressure in the controlled chamber is a function of the value of the fluid pressure in the control chamber.

3. The controllable double-acting hydraulic jack circuit according to claim 1, wherein a slide of the distributor is maintained resiliently in a neutral position and slidable toward first and second extreme positions under the influence of respective positive and negative pressure differences between the fluid pressure in the controlled chamber and the fluid pressure in the control chamber.

4. The controllable double-acting hydraulic jack circuit according to claim 3, wherein the slide, when moved toward one of said first and second extreme positions under the influence of a positive pressure difference between the fluid pressure in the controlled chamber and the fluid pressure in the control chamber, interrupts said first communication of fluid.

5. The controllable double-acting hydraulic jack circuit according to claim 3, wherein the slide, when moved toward one of said first and second extreme positions under the influence of a positive pressure difference between the fluid pressure in the controlled chamber and the fluid pressure in the control chamber, interrupts said first communication of fluid while establishing said third communication of fluid.

* * * * *